US012252937B2

(12) United States Patent
Keskiniva

(10) Patent No.: US 12,252,937 B2
(45) Date of Patent: Mar. 18, 2025

(54) DRILLING DEVICE WITH FLUID COLUMN RESONATOR

(71) Applicant: Mincon International Limited, Shannon (IE)

(72) Inventor: Markku Keskiniva, Ylinen (FI)

(73) Assignee: Mincon International Limited, Shannon (IE)

( * ) Notice: Subject to any disclaimer, the term of this patent is extended or adjusted under 35 U.S.C. 154(b) by 0 days.

(21) Appl. No.: 18/035,125

(22) PCT Filed: Nov. 5, 2021

(86) PCT No.: PCT/EP2021/080802
§ 371 (c)(1),
(2) Date: May 3, 2023

(87) PCT Pub. No.: WO2022/096661
PCT Pub. Date: May 12, 2022

(65) Prior Publication Data

US 2023/0407704 A1 Dec. 21, 2023

(30) Foreign Application Priority Data

Nov. 6, 2020 (IE) ..... S2020/0253

(51) Int. Cl.
*E21B 1/28* (2006.01)
*E21B 1/24* (2006.01)
*E21B 4/14* (2006.01)

(52) U.S. Cl.
CPC . *E21B 1/24* (2020.05); *E21B 4/14* (2013.01)

(58) Field of Classification Search
CPC ... E21B 1/00; E21B 7/24; E21B 28/00; E21B 1/38; E21B 1/02; E21B 1/26; E21B 1/28; B25D 9/125
See application file for complete search history.

(56) References Cited

U.S. PATENT DOCUMENTS 1,503,922 A * 8/1924 Slater ..... B25D 9/125 60/370
3,163,240 A * 12/1964 Bodine ..... E21B 7/24 175/107

(Continued)

FOREIGN PATENT DOCUMENTS

CN 106593293 A 4/2017

OTHER PUBLICATIONS

International Search Report from corresponding International Patent Application No. PCT/EP2021/080802, dated Jan. 31, 2022.

(Continued)

*Primary Examiner* — Kipp C Wallace
(74) *Attorney, Agent, or Firm* — Renner, Otto, Boisselle & Sklar, LLP

(57) ABSTRACT

The present invention relates to a drilling device. The device comprises at least one drill rod, the or each drill rod having a first cylindrical wall defining an elongate chamber for receiving a working fluid to form a fluid column, the length of the fluid column being equal to a total length of the elongate chambers of the or each drill rod. The device also comprises a displacement excitation device arranged at a proximal end of the fluid column and configured to excite the fluid column to cause the working fluid in the fluid column to oscillate, wherein the excitation device is configured to excite the fluid column at an excitation frequency at or within 10% of a natural frequency of the fluid column determined based on the fluid column having a fixed boundary condition at a proximal end thereof. The device further comprises a tool piston moveably mounted at a distal end of the fluid column and a drilling tool connected to the tool piston such that the oscillation of the working fluid in the fluid column imparts an oscillating force to the drilling tool.

16 Claims, 15 Drawing Sheets

(56) References Cited

U.S. PATENT DOCUMENTS

| | | | | |
|---|---|---|---|---|
| 3,532,174 | A * | 10/1970 | Hinks | E21B 7/24 175/56 |
| 3,610,347 | A | 10/1971 | Diamantides et al. | |
| 8,770,313 | B2 * | 7/2014 | Weddfelt | E21B 28/00 173/144 |
| 2004/0000185 | A1 * | 1/2004 | Couturier | B25D 9/125 72/705 |
| 2006/0185864 | A1 * | 8/2006 | Keskiniva | E21B 44/08 173/1 |
| 2009/0038817 | A1 * | 2/2009 | Weddfelt | E21B 28/00 173/144 |
| 2017/0198525 | A1 * | 7/2017 | Feddema | E21B 47/00 |
| 2022/0274239 | A1 * | 9/2022 | Swinford | B25D 9/125 |

OTHER PUBLICATIONS

Written Opinion from corresponding International Patent Application No. PCT/EP2021/080802, dated Jan. 31, 2022.

* cited by examiner 1
2
3
4
5
6
7
8
9
10
11
12
13
15
16
17
21
22
23
$Q_{water}$
$L_{leak}$ 4
30
31
A
B
41
42
44
45
CU
46
47

DRILLING DEVICE WITH FLUID COLUMN RESONATOR

FIELD OF THE INVENTION

The present invention relates to drilling devices in which fluid column resonance is used to generate an impulse force.

BACKGROUND TO THE INVENTION

Conventional rotary drilling devices comprise a rotary drill bit, such as a tricone rotary drill bit, arranged at the end of a drill string which is rotated by a machine to cause the drill bit to penetrate the rock to be drilled. The penetration rate, and thus the drilling speed, is dependent on the rotation rate of the drill string and the Weight on Bit applied to the drill bit.

Percussion assisted rotary drilling arrangements have been proposed, such as that disclosed in United States Patent Application Publication No. US 2013/0098684. In this arrangement, rotary drilling is assisted by pneumatic down-the-hole drilling in order to improve drilling speed. However, the output power of the hammer must be limited to very low values in order to prolong the life of the tricone rotary drill bit, as the high impact forces generated by the down-the-hole hammer causes significant wear on the bit.

Another arrangement is disclosed in International Patent Application No. WO 2007/042618, which includes both a percussion device and a rotation motor with a tricone rotary drill bit, wherein the rotation motor rotates a drill rod and the drill bit and the percussion device provides stress pulses of low amplitude at high frequency via a drill rod and the drill bit. However, the impulse device required to generate the high frequency stress pulses is complex.

It is desirable to provide a drilling device that overcomes a number of the disadvantages associated with existing devices. In particular, it is desirable to provide a drilling device that produces a drilling action that can be used alone, or to enhance the drilling speed of rotary drilling.

SUMMARY OF THE INVENTION

The present invention relates to a drilling device comprising:

- at least one drill rod, the or each drill rod having a first cylindrical wall defining an elongate chamber for receiving a working fluid to form a fluid column, the length of the fluid column being equal to the total length of the elongate chambers of the or each drill rod;
- a displacement excitation device arranged at a proximal end of the fluid column and configured to excite the fluid column to cause the working fluid in the fluid column to oscillate, wherein the excitation device is configured to excite the fluid column at an excitation frequency at or within 10% of a natural frequency of the fluid column determined based on the fluid column having a fixed boundary condition at the proximal end thereof; and
- a tool piston moveably mounted at a distal end of the fluid column and a drilling tool connected to the tool piston such that the oscillation of the working fluid in the fluid column imparts an oscillating force to the drilling tool.

In preferred embodiments, the excitation frequency is at or within 5% of the natural frequency of the fluid column. Ideally, the excitation frequency is within 1% of the natural frequency of the fluid column. The closer the excitation frequency is to a natural frequency of the fluid column, the closer operation of the device is to resonance. Excitation frequencies within 10% of a natural frequency of the fluid column cause displacement of fluid in the fluid column with an amplitude large enough to allow sufficient force to be imparted to the drilling tool to produce or enhance a drilling action.

The drilling device may be considered to be a down-the-hole drilling device, since the tool piston is arranged in the drilled hole during drilling.

A fluid column has a number of natural frequencies that are a function of the properties of the fluid, the length of the column and the boundary conditions applied to the column. In the present case, the natural frequencies are determined based on the fluid column having a fixed boundary condition at its proximal end; that is, no displacement or flow of fluid occurs at the proximal or driver end of the fluid column (relative to the end walls of the column).

Generally, where a stiffness of the fluid is lower than a stiffness of the rock-tool interaction, the distal end of the fluid column may also be considered to have a substantially fixed boundary condition. Assuming a fixed-fixed boundary condition, the natural frequencies of the fluid column can be determined using the equation:

$$f_n = \frac{kc_{wave}}{2L},\ c_{wave} = \sqrt{\frac{B_{fluid}}{\rho_{fluid}}} \tag{1}$$

where $f_n$ is the natural frequency, k is the order of the natural frequency, L is the length of the fluid column, $B_{fluid}$ is a fluid bulk modulus and $\rho_{Fluid}$ is fluid density. FIGS. 3 and 4 show displacement and pressure, respectively, along the length of a fluid column for a fixed-fixed boundary condition for k=1, 2 and 3. As shown in FIG. 3, displacement nodes are seen at each end of the fluid column in accordance with the applied fixed-fixed boundary condition. As shown in FIG. 4, a pressure antinode is seen at the proximal end of the fluid column.

In situations where the stiffness of the rock-tool interaction has a very low value such that it does not correspond to a fixed boundary condition at the distal end of the column, this can be accounted for using frequency control mechanisms discussed below.

In order to cause oscillation of the working fluid in the fluid column, an excitation must be introduced. According to the present invention, a displacement excitation device is arranged at a proximal end of the fluid column and configured to excite the fluid column to cause the working fluid in the fluid column to oscillate. The displacement excitation device may introduce excitation by reciprocally displacing a proximal end wall of the chamber (of the drill rod, or the most proximal drill rod) in a longitudinal direction of the chamber, or otherwise changing the volume of the fluid column in a reciprocal manner.

Resonance occurs in the fluid column when the excitation frequency and the natural frequency of the fluid column coincide. Exciting the fluid column at an excitation frequency at or close to a natural frequency of the fluid column therefore allows the system to operate at or close to resonance so that the amplitude of the displacement of the fluid in the fluid column will grow substantially. Likewise, the pressure oscillation in the fluid column will have high amplitudes. This allows the impulse associated with the force imparted to the drilling tool to be maximised.

Impulse generators for percussion tools have been suggested, in which the natural frequency of the system is determined using a free boundary condition at the proximal end of a fluid column. In such systems, the excitation is introduced by way of a force or pressure excitation at the proximal end of the fluid chamber. A small amplitude pressure excitation at the proximal end of the chamber creates a large fluid displacement at the proximal end (displacement antinode) and a large pressure amplitude at the distal end (pressure antinode). The large fluid displacement at the proximal end leads to a very high flow requirement as high volumes of fluid are required to move in and out of the fluid column. Thus, such systems only require a small pressure variation but must be capable of delivering high flow rates.

The drilling device of the present invention is advantageous in that it includes a displacement excitation device. This type of excitation device creates a high pressure amplitude at the proximal end (and correspondingly at the distal end) of the fluid column, but requires a much lower peak fluid flow rate. The present invention therefore allows for a more compact and cheaper system and encounters much lower fluid-flow related power losses than a system which has a free boundary condition at the proximal end.

Generally, the chamber is for receiving a liquid to form the fluid column; that is, the working fluid in the fluid column is a liquid. The type of liquid used does not have a significant impact on the performance of the drilling device, since the natural frequency of the fluid column is based on the properties of the liquid used. In certain embodiments, the liquid is hydraulic oil. Hydraulic oil is suitable for single pass drilling applications; that is, where drill rods are not added or removed while drilling the hole. Generally, sealing of the device at the distal end is advantageous to avoid leakage of working fluid. Where oil is used in a single pass device, a radial seal may be easily implemented at the distal end of the device, due to the high viscosity and good lubrication properties of hydraulic oil. However, for extension drilling, where additional drill rods are added to the drilling device or drill string as the hole gets deeper, there is a risk of oil leakage from the fluid column as new rods are added. Introducing a valve arrangement for the individual drill rods to prevent oil leakage would interfere with the oscillation of the fluid column.

In other embodiments, the liquid is water. Water is particularly suitable for extension drilling applications since it is harmless to the environment, and leakage when adding or removing drill rods is therefore not a concern. However, water leakage via a clearance between the first cylindrical wall and the tool piston at the distal end of the device may be an issue as sealing around the tool piston may be challenging.

The drilling device may further comprise at least one outlet for water at a distal end of the fluid column and means for pumping water into the fluid column at an input flow rate, such that the water flows along a leakage fluid path between the first cylindrical wall and the tool piston and out of the at least one outlet at a leakage flow rate equal to the input flow rate. In this way, the leakage of water between the cylindrical wall and the tool piston may be used either to flush the hole, or to suppress dust generated when another flushing fluid such as air is used to flush the drilled hole. This also has the advantage of not requiring a seal at the tool piston.

In one embodiment, the or each drill rod comprises a second cylindrical wall arranged outside at least a portion of the first cylindrical wall such that an annular flushing channel is defined between the first and second cylindrical walls and the annular flushing channel is configured to receive a flushing fluid at a proximal end thereof and discharge the flushing fluid at a distal end thereof. In this embodiment, the outlet may be provided at a distal end of the fluid column, adjacent the distal end of the flushing channel.

This allows the leakage water to be used to suppress dust generated when the flushing fluid is, for example, air. The dust created by the use of air as a flushing fluid may cause significant problems. Leakage of water from the fluid column is therefore leveraged to suppress the dust, without requiring a separate water supply. Water is pumped into the fluid column at an input flow rate equal to the leakage flow rate required for dust suppression. In conventional rotary drilling, where water is injected into the flushing air for dust suppression, it enters the bearings of the tricone cutters and and washes away the bearing lubricant. However, in this embodiment the outlet for the leakage water is at a distal end of the fluid column, but rearward of the drill bit so that the water does not enter the cutter bearing section of the bit.

In another embodiment, the outlet is provided at a distal face of the drilling tool. This allows the water itself to be used as a flushing fluid. The input flow rate and the tool piston dimensions are selected such that the leakage flow rate is sufficient for flushing.

In both embodiments, extension drilling is straightforward. Preferably, each elongate chamber has a length l and the length of the fluid column L is an integer multiple of l. The water in the fluid column may be allowed to drain out when adding or removing drill rods and the device is then refilled with water before drilling is restarted. Because each drill rod has the same length l, addition or removal of a drill rod does not require a change to the excitation frequency. Where the excitation frequency is chosen as the $k^{th}$ natural frequency of a drilling device with a fluid column of length l, then where N drill rods of length l are used, the excitation frequency becomes the $N*k^{th}$ natural frequency of the drilling device with a fluid column of length $L=N*l$.

The displacement excitation device may be arranged to reciprocally move the fluid in the fluid column in a longitudinal direction.

In one embodiment, the displacement excitation device comprises an excitation piston disposed in a proximal end of the chamber such that a forward end of the excitation piston forms a proximal end wall of the fluid column. The excitation piston is coupled to a crankshaft mechanism such that the piston is driveable reciprocally in a longitudinal direction of the fluid column to reciprocally displace the proximal end wall of the fluid column.

In another embodiment, the displacement excitation device comprises a cam mechanism arranged at a proximal end of the chamber such that each of a plurality of pistons is driveable reciprocally in a radial direction by a rotatable cam, to change the volume of the chamber in which the fluid column is established in a reciprocal fashion.

In another embodiment, the displacement excitation device comprises an epicycloid mechanism comprising a multi-lobed rotor having N lobes arranged to orbit within a multi-lobed stator having N+1 lobes, such that N+1 cavities of varying volume are created between the rotor and the stator, and wherein a first group of the N+1 cavities are in fluid communication with each other and with the chamber to change the volume of the chamber in which the fluid column is established in a reciprocal manner. A second group of the N+1 cavities may be in fluid communication with each other and connected to a source of fluid at a substantially constant pressure. This reduces the pressure forces to which the rotor is subjected during operation.

DETAILED DESCRIPTION OF THE DRAWINGS

Figure 1:
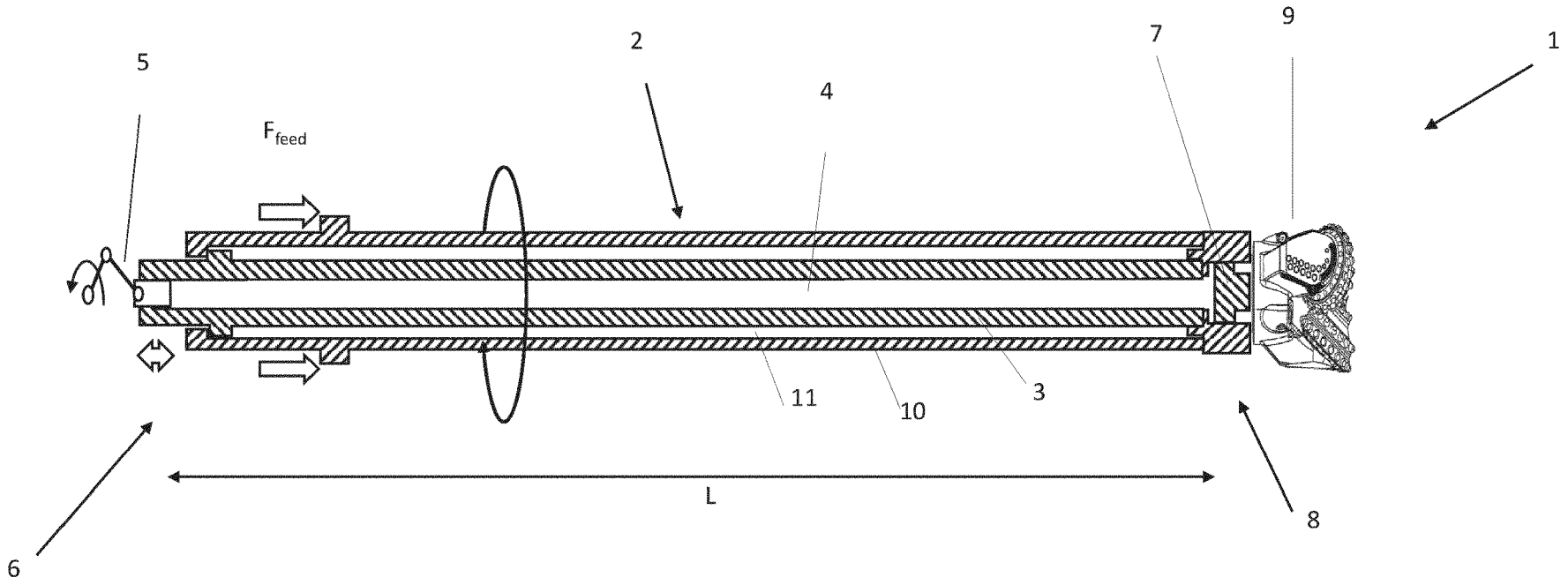
FIG. 1 is a part-schematic cross-sectional view of a drilling device according to a first embodiment of the invention.

FIG. 1 shows a drilling device 1 according to an embodiment of the present invention. The device 1 comprises a drill rod 2 having a first cylindrical wall 3 defining an elongate chamber 4. The chamber 4 receives a working fluid, such as hydraulic oil or water, to form a fluid column. In the embodiment shown in FIG. 1, only a single drill rod is included and so the fluid column has a length L equal to the length of the elongate chamber 4. As will be described in more detail below, additional drill rods may be added to the device such that the fluid column has a length that is an integer multiple of the length of the elongate chamber 4. The drill rod or rods are disposed in the drilled hole during drilling. The drill rod 2 also comprises a second cylindrical wall 10 arranged outside the first cylindrical wall. An annular flushing channel 11 is defined between the first and second cylindrical walls.

The device 1 further includes a displacement excitation device 5 arranged at a proximal end 6 of the fluid column. In the embodiment shown in FIG. 1, the displacement excitation system comprises a crankshaft arrangement. This will be described in more detail below in relation to FIG. 7. The displacement excitation device is configured to excite the fluid column at a frequency close to a natural frequency of the fluid column determined based on a fixed-fixed boundary condition, to cause the working fluid in the fluid column to oscillate. For a fixed-fixed boundary condition, the natural frequencies of the fluid column can be determined using the equation:

$$f_n = \frac{kc_{wave}}{2L},\ c_{wave} = \sqrt{\frac{B_{fluid}}{\rho_{fluid}}} \tag{1}$$

where $f_n$ is the natural frequency, k is the order of the natural frequency, L is the length of the fluid column, $B_{fluid}$ is a fluid bulk modulus and $\rho_{fluid}$ is fluid density. Selection of the excitation frequency is described in more detail in relation to FIGS. 12 and 13.

The drilling device 1 further comprises a tool piston 7 moveably mounted at a distal end 8 of the fluid column and a drilling tool 9 connected to the tool piston such that the oscillation of the working fluid in the fluid column imparts an oscillating force to the drilling tool. In the embodiment shown in FIG. 1, the drilling tool 9 is a rotary tricone bit and the drilling device is rotatable about a longitudinal axis as indicated by the arrow.

Figure 2:
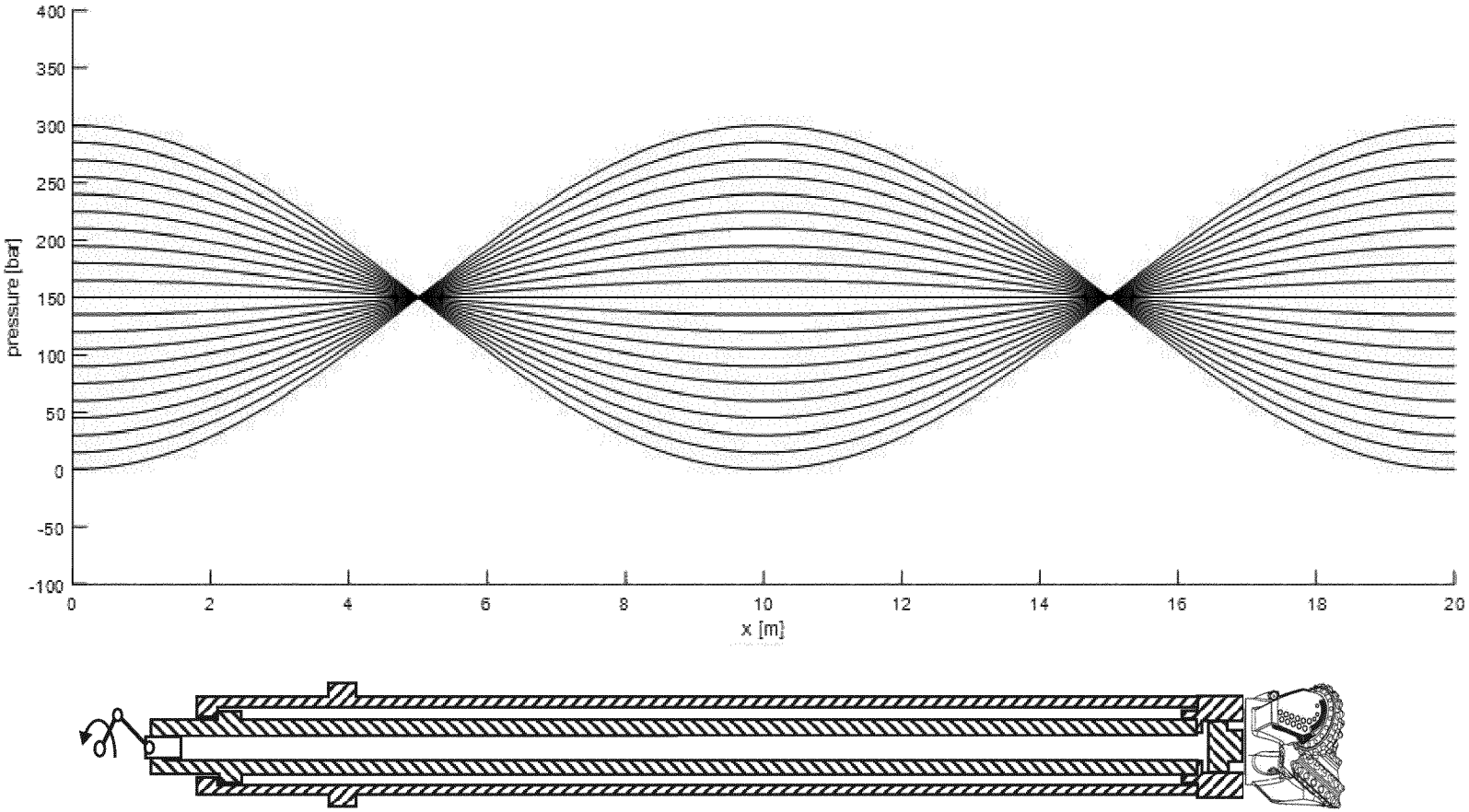
FIG. 2 is a graph of pressure in bar along the length of the fluid column of the drilling device shown in FIG. 1.
Figure 3:
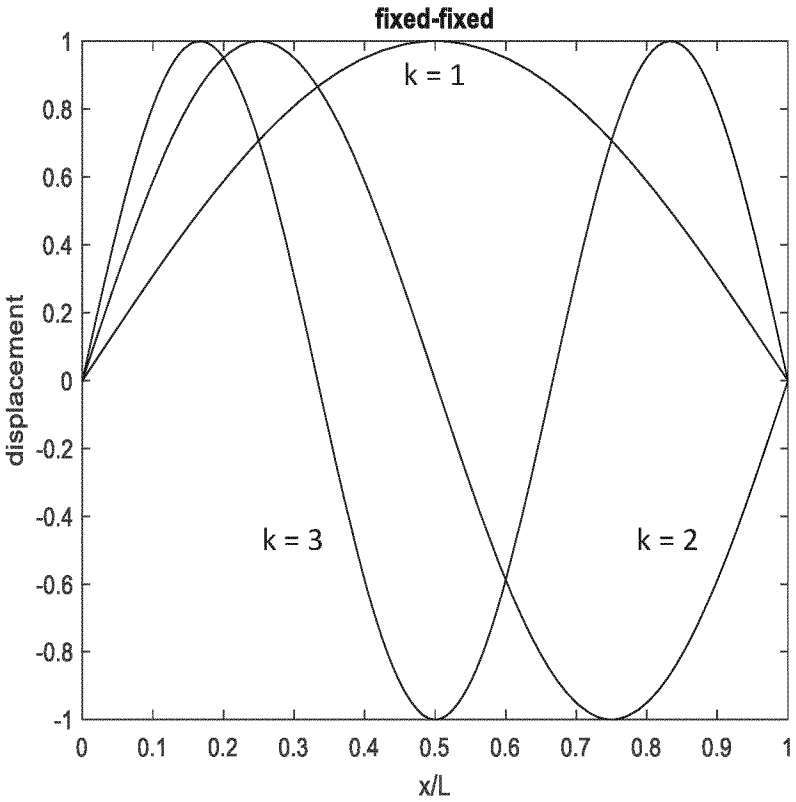
FIG. 3 is a graph of displacement along the length of a fluid column having a fixed boundary condition at its proximal end for the first, second and third natural frequencies of the fluid column.
Figure 4:
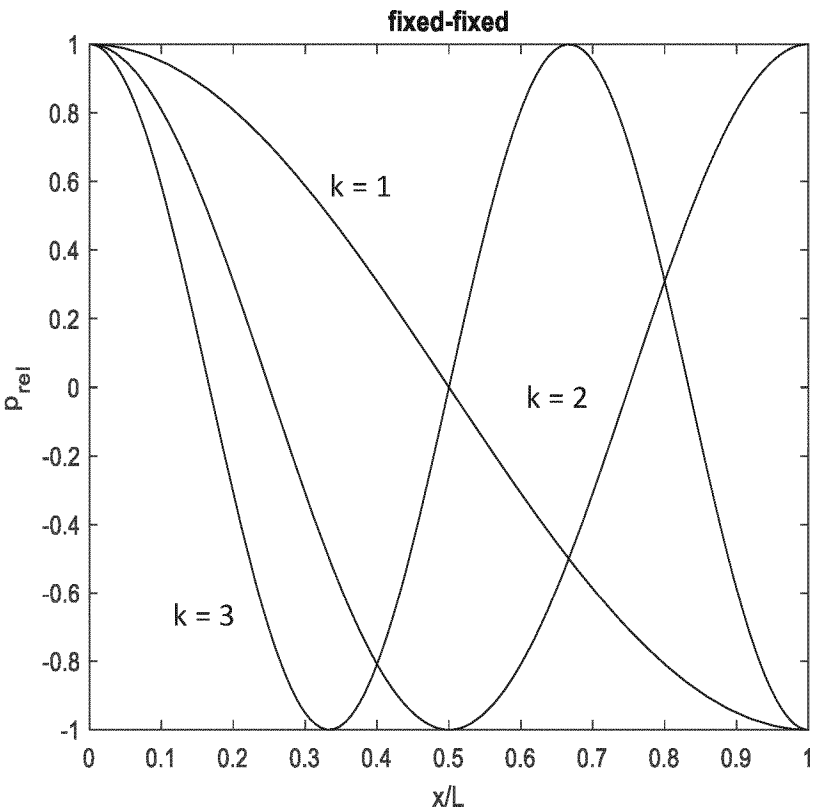
FIG. 4 is a graph of pressure along the length of a fluid column having a fixed boundary condition at its proximal end for the first, second and third natural frequencies of the fluid column.

FIG. 2 illustrates the pressure oscillation along an exemplary fluid column, such as that of FIG. 1, when the fluid is excited at an excitation frequency close to the second natural frequency of the fluid column. As shown in FIG. 2, in this embodiment, the fluid column is 20 metres in length and pressure nodes (where the pressure has a constant value of $p_{static}$) are seen at 5 meters and 15 metres from the proximal end of the chamber, respectively. Pressure antinodes (where the pressure has the highest amplitude) are seen at the proximal end of the chamber, at the midpoint of the chamber and at the distal end of the chamber. At the pressure antinodes, the pressure varies between $p_{static}+p_{osc}$ amplitude and $p_{static}-p_{osc\ amplitude}$. The static pressure, $p_{static}$, can be generated by a feed force $F_{feed}$ (using Weight on Bit) or by pressurising the fluid column, or both.

Due to the pressure oscillation in the fluid column, the force on the tool piston and thus, the drilling tool, will oscillate accordingly. Where the drilling device is a rotary drilling device, as shown in FIG. 1, the drilling will mainly be done as conventional rotary drilling (using Weight on Bit and rotation) and the oscillating force imparted to the tool is used to enhance the drilling speed. Alternatively, the high frequency, high amplitude oscillating force alone may be used to perform a drilling action. In this embodiment, it is preferable to have the static pressure $p_{static}$ very close to the pressure oscillation amplitude so that the force on the tool face is close to zero when the pressure is $p_{static}-p_{osc\ amplitude}$. This allows the drill bit or tool to be rotated for the purpose of bit indexing, without severe wear on inserts in the cutting face of the tool.

Figures 5A, 5B:
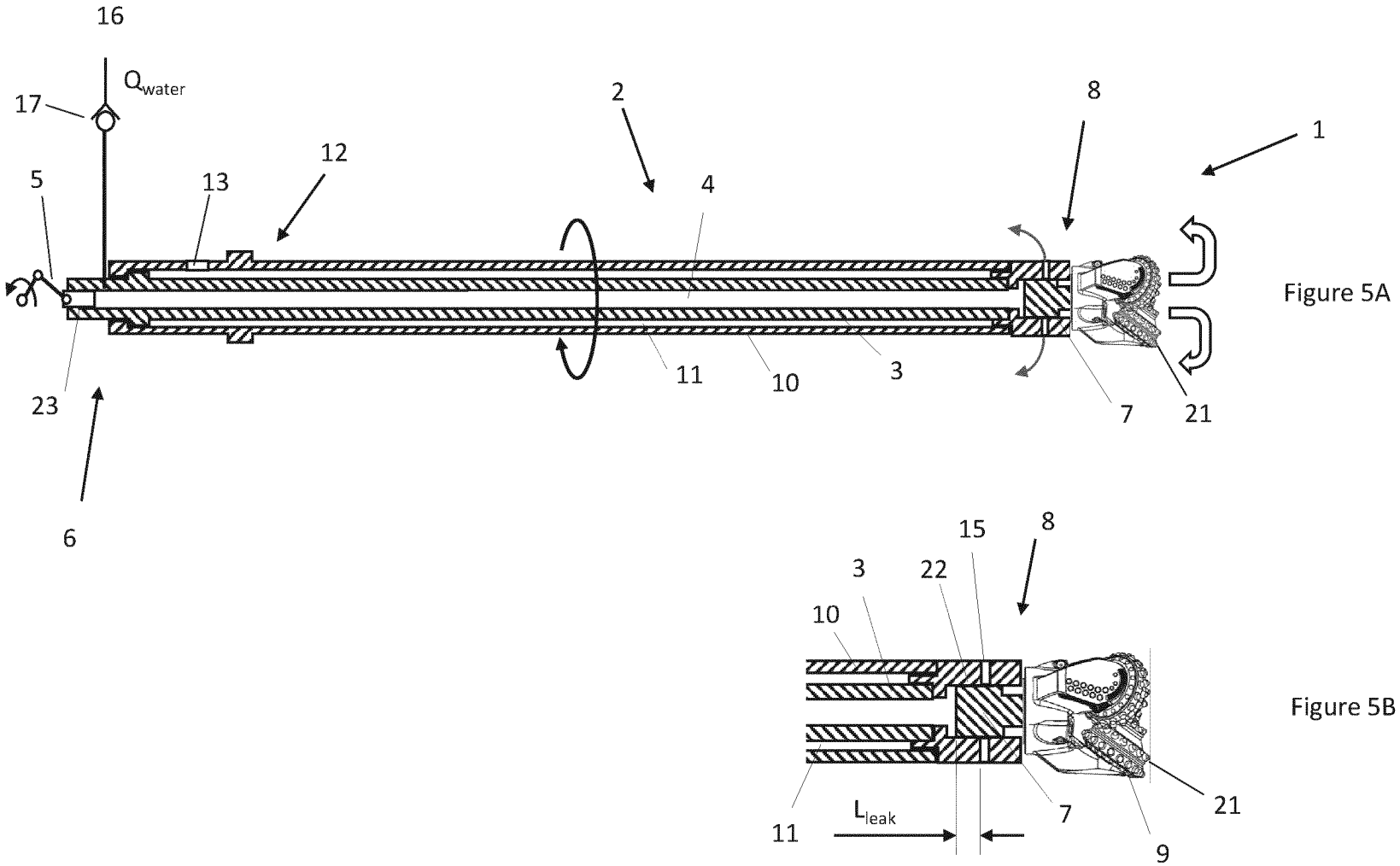
FIG. 5A is a part-schematic cross-sectional view of a drilling device according to a second embodiment of the invention.
FIG. 5B is a magnified view of a distal end of the device shown in FIG. 5A.

FIGS. 5A and 5B show another embodiment of a drilling device according to the present invention. This embodiment is similar to that shown in FIG. 1 and uses water as the working fluid. As shown in FIG. 5A, in this embodiment, the annular flushing channel 11 is configured to receive a flushing fluid, such as air, at a proximal end 12 thereof via inlet 13 and discharge the flushing fluid through outlets (not shown) in a distal face 21 of the drilling tool.

The drilling device 1 further comprises a plurality of injection holes 15 for water at a distal end 8 of the first cylindrical wall 3, adjacent the distal end 14 of the flushing channel. The device 1 also comprises a pump 16 for pumping water into a proximal end 6 of the fluid column at an input flow rate. A check valve 17 is provided to prevent back flow and a seal 23 is provided at the excitation device 5 to prevent leakage of water from the proximal end of the drilling device. As shown in FIG. 5B, water flows along a leakage fluid path 22 having a length $L_{leak}$ between the first cylindrical wall 3 and the tool piston 7 and out of the outlets 15 at a leakage flow rate equal to the input flow rate.

In use, flushing air is supplied to the flushing channel and discharged into the drilled hole through the drilling tool to evacuate cuttings from the drilled hole. Water is supplied to the fluid column at an input flow rate and water pressure at the tool 9 induces leakage through the clearance between the piston 7 and the first cylindrical wall 3. This leakage water enters the drilled hole via the injection holes 15 in the wall 3, where it mixes with the flushing air and drill cuttings, providing dust suppression. The leakage flow is dependent on the length $L_{leak}$ of the leakage fluid path. The shorter the length of the path, the higher the leakage flow rate. If more water is pumped in by the pump 16 than is leaking out, the tool piston 7 will be pushed out in a distal direction, thereby maintaining a constant static pressure in the fluid column. This, in turn, decreases the length of the leakage path $L_{leak}$, increasing the leakage flow rate so that the tool piston 7 is automatically driven to a position where the leakage flow rate is the same as the input flow rate.

Figure 6A:
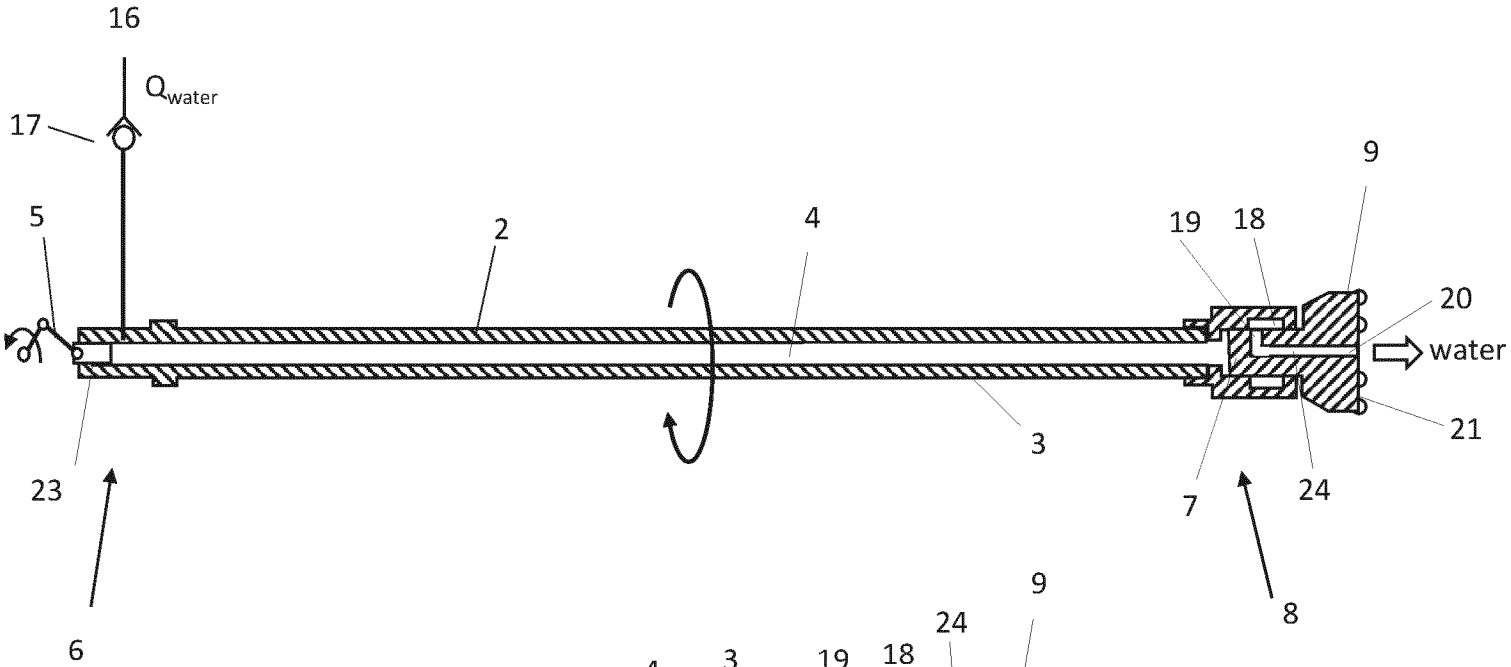
FIG. 6A is a part-schematic cross-sectional view of a drilling device according to a third embodiment of the invention.
Figure 6B:
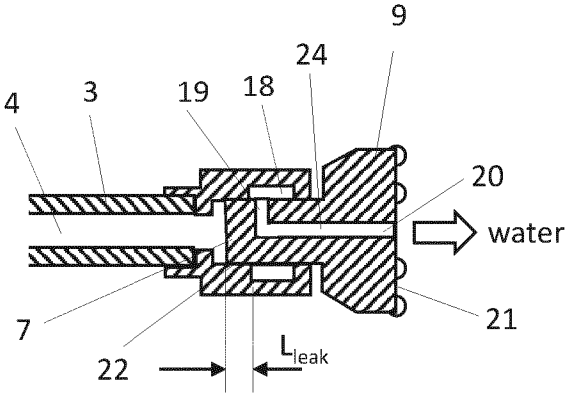
FIG. 6B is a magnified view of a distal end of the device shown in FIG. 6A.

Another embodiment is shown in FIGS. 6A and 6B, in which the water from the fluid column is itself used to flush the drilled hole. In this embodiment, the drill rod comprises only a single cylindrical wall 3. The device 1 further comprises a pump 16 for pumping water into a proximal end 6 of the fluid column at an input flow rate. A check valve 17 is provided to prevent back flow and a seal 23 is provided at the excitation device 5 to prevent leakage of water from the proximal end of the drilling device. In this embodiment, the tool piston 7 and drilling tool 9 are integrally formed with one another. As shown in FIG. 6B, a fluid channel 24 is provided through the tool piston and drilling tool between inlets 19 in the tool piston and an outlet 20 in the distal or cutting face 21 of the drilling tool. As also shown in FIG. 6B, water flows along a leakage fluid path 22 having a length $L_{leak}$ between the cylindrical wall 3 and the tool piston 7 and into undercuts 18 provided in an inner surface of the wall 3 at a distal end thereof. From there, the water flows into the drilling tool 9 via the inlets 19, and is conducted through the drilling tool to the outlet 20 at the distal face 21 of the tool.

As in the previous embodiment, in use, water is supplied to the fluid column at an input flow rate and water pressure at the tool 9 induces leakage through the clearance between the piston 7 and the cylindrical wall 3. This leakage water enters the drilled hole via the outlet 20 in the cutting face of the tool, where it is used to flush cuttings from the hole. As before, the leakage flow is dependent on the length $L_{leak}$ of the leakage fluid path. The shorter the length of the path, the higher the leakage flow rate. If more water is pumped in by the pump 16 than is leaking out, the tool piston 7 will be pushed out in a distal direction thereby maintaining a constant static pressure in the fluid column. This, in turn, decreases the length of the leakage path $L_{leak}$, increasing the leakage flow rate so that the tool piston 7 is automatically driven to a position where the leakage flow rate is the same as the input flow rate.

Figure 16:
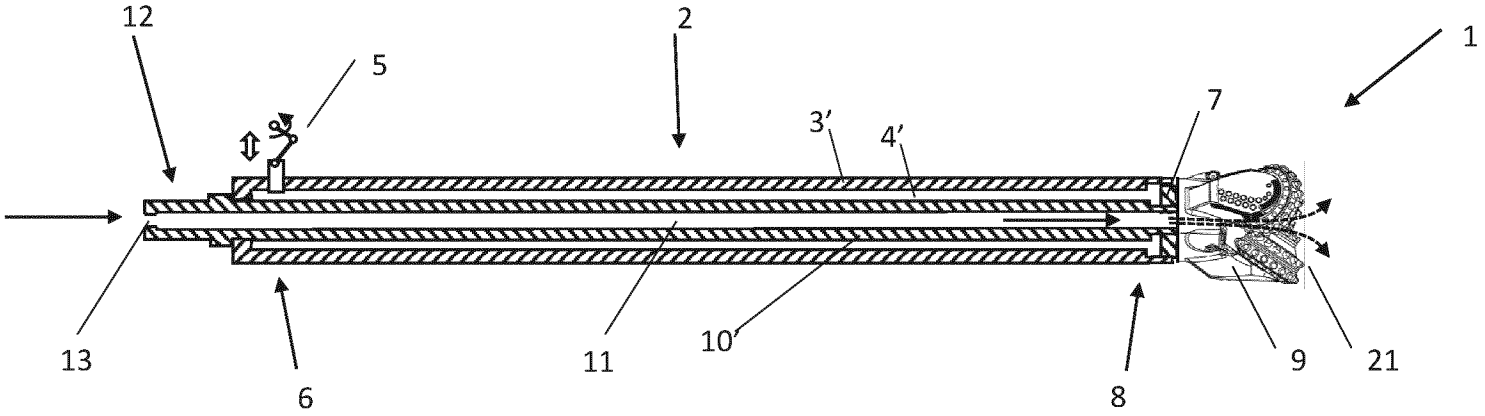
FIG. 16 is a part-schematic cross-sectional view of a drilling device according to an embodiment of the invention

A further embodiment of the invention is shown in FIG. 16. The device 1 comprises a drill rod 2 having a first cylindrical wall 3' defining, with a second inner cylindrical wall 10' arranged inside the first cylindrical wall, an elongate chamber 4'. That is, an elongate annular chamber 4' is defined between the first and second cylindrical walls. The chamber 4' receives a working fluid, such as hydraulic oil or water, to form a fluid column. In the embodiment shown in FIG. 16, only a single drill rod is included and so the fluid column has a length L equal to the length of the elongate chamber 4'. Additional drill rods may be added to the device such that the fluid column has a length L that is an integer multiple of the length of the elongate chamber. The drill rod or rods are disposed in the drilled hole during drilling.

The device 1 further includes a displacement excitation device 5 arranged at a proximal end 6 of the fluid column. In the embodiment shown in FIG. 16, the displacement excitation system comprises a crankshaft arrangement. The drilling device 1 further comprises a tool piston 7 moveably mounted at a distal end 8 of the fluid column and a drilling tool 9 connected to the tool piston such that the oscillation of the working fluid in the fluid column imparts an oscillating force to the drilling tool.

In this embodiment, an inner flushing channel or pipe 11 defined by the inner cylindrical wall 10' is configured to receive a flushing fluid, such as air, at a proximal end 12 thereof via inlet 13 and discharge the flushing fluid through outlets in a distal face 21 of the drilling tool 9. In use, flushing air is supplied to the flushing channel and discharged into the drilled hole through the drilling tool to evacuate cuttings from the drilled hole. Where the working fluid is water, a leakage flow of water may be provided, similar to the arrangements described above. Where the working fluid is oil or another fluid, there is no leakage of working fluid from the chamber.

In the embodiment shown in FIG. 16, the drilling tool 9 is a rotary tricone bit and the drilling device is rotatable about a longitudinal axis. The drill tool may be rotated with the inner flushing pipe 11. The outer cylindrical wall 3' may also rotate, or it may remain stationary.

Figure 7:
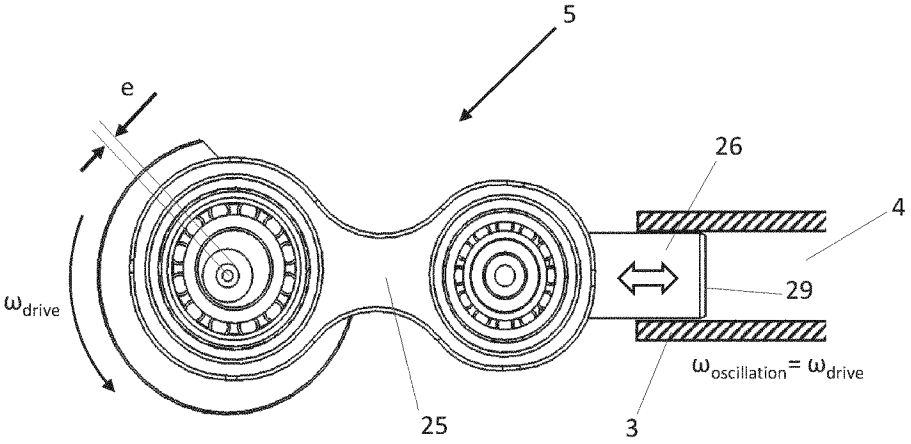
FIG. 7 is a cross-sectional view of a proximal end of a drilling device according to an embodiment of the invention, in which the displacement excitation device comprises a crankshaft.

FIG. 7 illustrates a first embodiment of a displacement excitation device for use in the present invention. The displacement excitation device 5 is arranged to reciprocally move the fluid in the fluid column in a longitudinal direction. In this embodiment, the displacement excitation device 5 comprises a crankshaft 25 having an eccentricity e arranged to drive an excitation piston 26 disposed in a proximal end of the chamber 4 in a reciprocal manner. A forward end 29 of the excitation piston forms a proximal end wall of the fluid column. Driving the excitation piston has the effect of reciprocally displacing the proximal end wall of the fluid column in a longitudinal direction. The excitation piston has a stroke length of 2e and reciprocates at a frequency $\omega_{oscillation}$ equal to the drive frequency $\omega_{drive}$ of the crankshaft. In this embodiment, as the excitation piston diameter is relatively large and the pressure amplitude of the fluid oscillation is relatively high, the pressure force on the crankshaft mechanism is relatively high. This means that the mechanism must be quite strong and, therefore, heavy with the result that the dynamic forces generated when the mechanism is running at high frequency may be substantial.

Figure 8B:
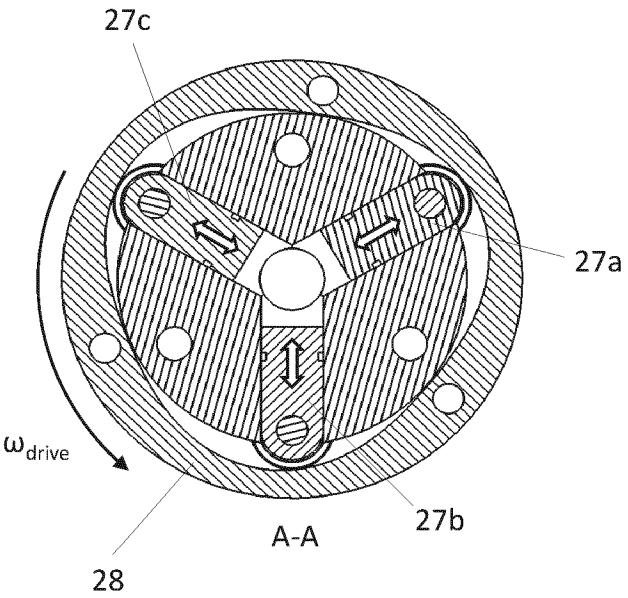
FIG. 8B is a transverse cross-section of the device of FIG. 8A, taken along line A-A.
Figure 8A:
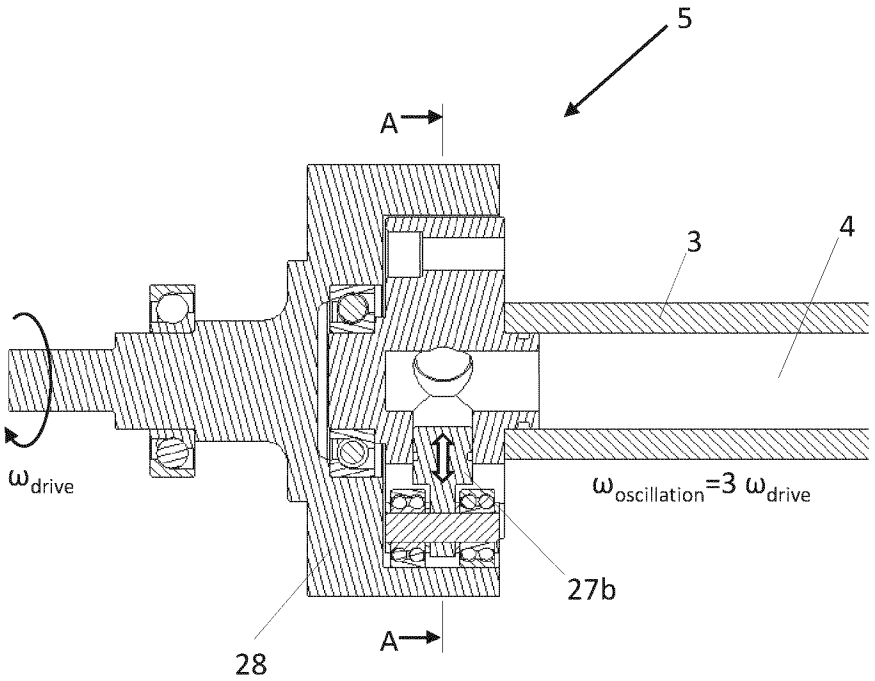
FIG. 8A is a longitudinal cross-sectional view of a proximal end of a drilling device according to an embodiment of the invention, in which the displacement excitation device comprises a cam mechanism.

FIGS. 8A and 8B illustrate another embodiment of a displacement excitation device for use in the present invention. In this embodiment, the displacement excitation device comprises a cam mechanism, in which three pistons 27*a*, 27*b* and 27*c* are driven reciprocally and simultaneously in a radial direction by a cam 28. This has the effect of changing the volume of the chamber in which the fluid column is established in a reciprocal fashion, thereby reciprocally moving the fluid in the fluid column in a longitudinal direction. The cam 28 is rotated at a drive frequency $\omega_{drive}$, so that the pistons 27*a*, 27*b*, 27*c* are driven at an excitation frequency of $\omega_{oscillation}=3\ \omega_{drive}$, thereby achieving a higher excitation frequency than the crankshaft mechanism for the same drive frequency. This mechanism is therefore more compact than the crankshaft described above and the dynamic forces generated are cancelled out due to the symmetrical nature of the mechanism.

Figure 9B:
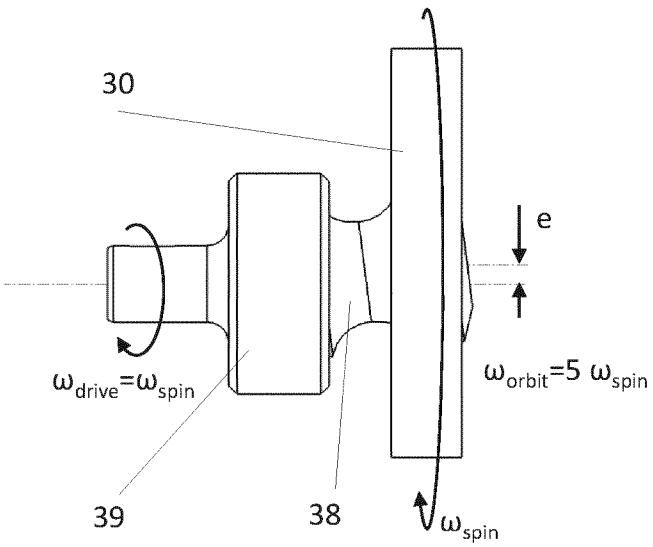
FIG. 9B is a side elevation view of the rotor of the epicycloid mechanism of FIG. 9A.
Figure 9A:
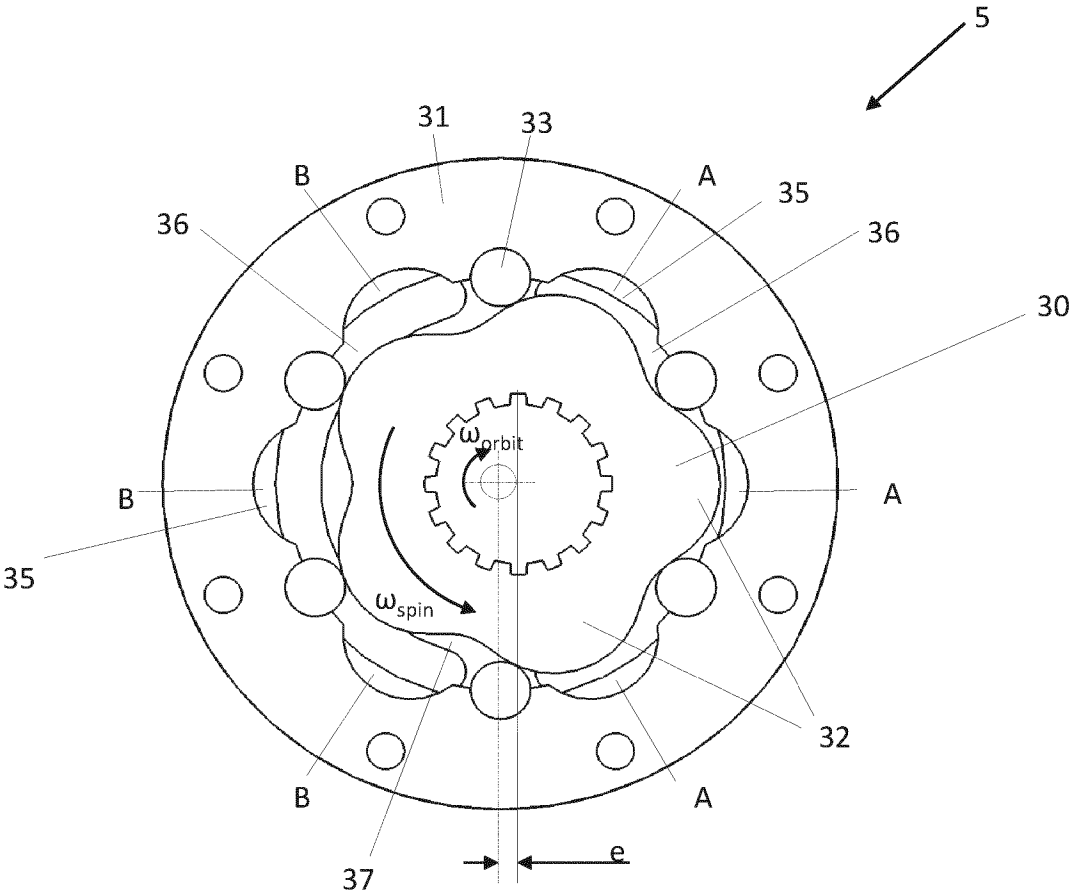
FIG. 9A is a transverse cross-section of an epicycloid mechanism, suitable for use as a displacement excitation device in a drilling device according to the present invention.

FIGS. 9A and 9B illustrate a further embodiment of a displacement excitation device for use in the present invention. In this embodiment, the displacement excitation device is based on an epicycloid mechanism similar to a gerotor or geroller type of hydraulic motor. The epicycloid mechanism comprises a rotor 30 having a plurality of lobes 32 which orbits at a frequency $\omega_{orbit}$ with an eccentricity of e about the centre of a stator 31 which also has a plurality of lobes, one greater than the number of lobes on the rotor. Stator pins 33 provide a seal between the stator casing and the rotor and also receive pressure-induced forces from the rotor. While orbiting, the rotor is also spinning about its centre at a frequency $\omega_{spin}$. The orbit and spin frequencies are related to one another by the equation $\omega_{orbit}=-N\ \omega_{spin}$, where N is the number of lobes 32 on the rotor 30. In the embodiment shown, the rotor has five lobes so that the orbit frequency is five times the drive frequency, in the opposite direction.

The arrangement of the stator and the rotor is such that N+1, or in this case, six cavities are formed between them as the rotor rotates. The volume of each cavity changes in a harmonic fashion with a frequency $\omega_{orbit}$. When used as a motor, each of these cavities is connected to high and low pressure lines with a valve system such that the cavity receives high pressure liquid when the cavity volume is increasing and the cavity is connected to a low pressure line when the cavity volume is decreasing. When used as an excitation mechanism, as in the present application, the cavities are divided into two sets, labelled A and B, respectively in FIG. 9A. All of the cavities in the same set are connected to each other by way of a groove 36 provided in a bottom face plate 37 of the stator. This means that the pressure in each of the cavities in the same group is equalised. As the rotor orbits, the total volume of each of the sets of cavities changes in a harmonic fashion. The displacement excitation for the fluid column is achieved by connecting the fluid column to one of the sets of cavities. The frequency of the excitation is the same as the orbit frequency $\omega_{orbit}$ of the rotor. The rotor may be driven in a number of ways. In the embodiment shown in FIG. 9B, the rotor is driven by a cardan shaft 38, connected to a drive shaft 39 at a first end and the rotor 30 at a second end. The rotor spins at a frequency $\omega_{spin}$ which is equal to the drive frequency $\omega_{drive}$ of the drive shaft. As set out above, the orbit frequency $\omega_{orbit}$, and thus the excitation frequency is N times the drive frequency, so that the system has a built-in step up gear.

Figure 10B:
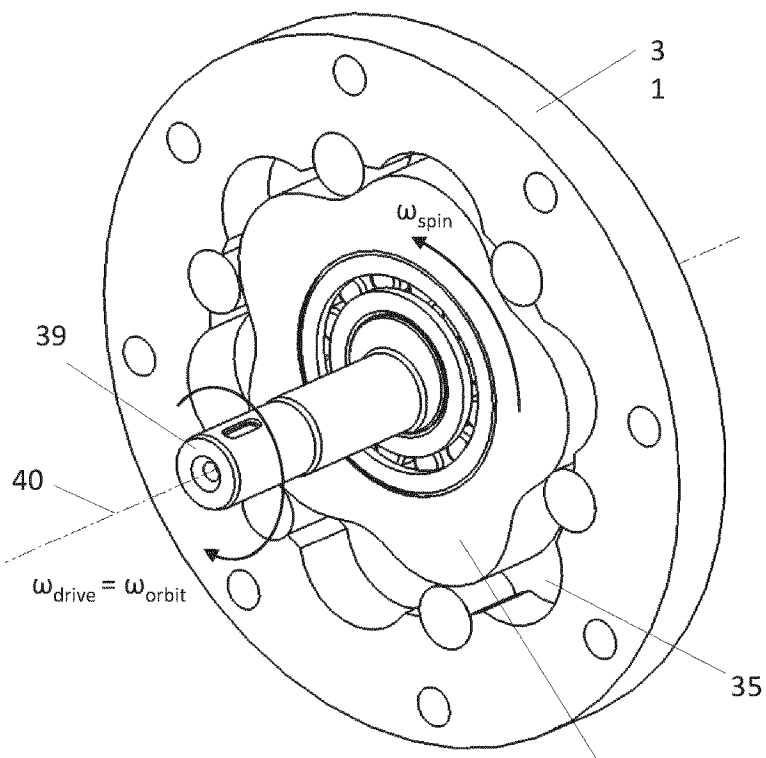
FIG. 10B is a perspective view of the epicycloid mechanism of FIG. 10A.
Figure 10A:
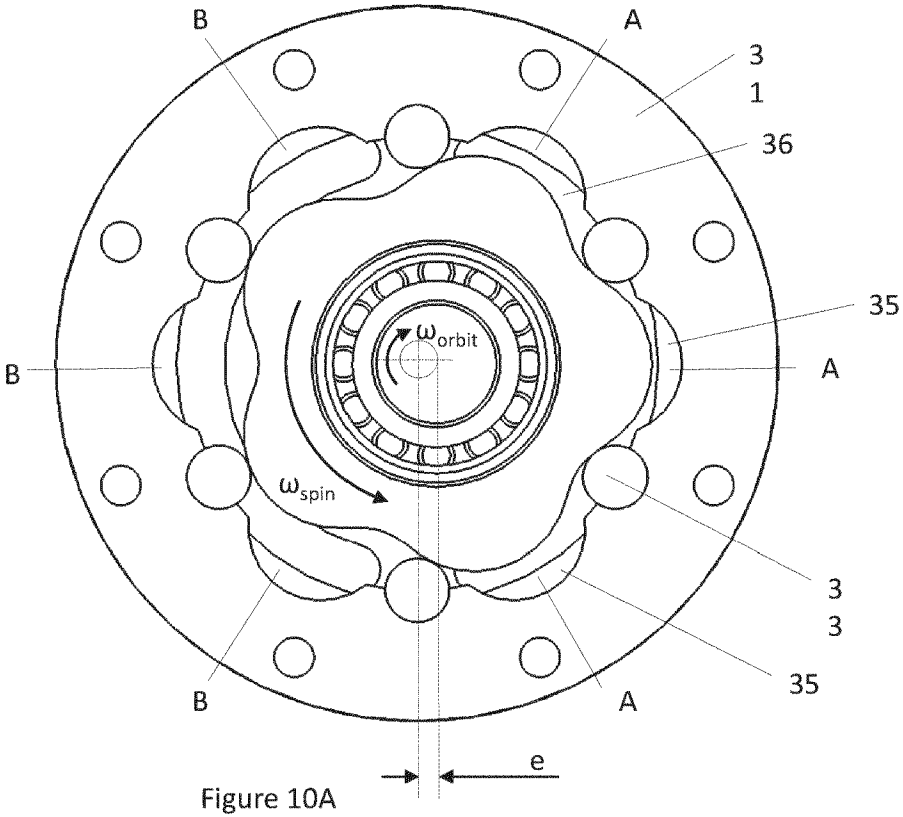
FIG. 10A is a transverse cross-section of an alternative epicycloid mechanism, suitable for use as a displacement excitation device in a drilling device according to the present invention.

An alternative drive arrangement for the rotor 30 is shown in FIGS. 10A and 10B. In this arrangement, the rotor is connected directly to the drive shaft 39 and has an eccentricity e with respect to the centre 40 of the drive shaft. In this case, the rotor is forced to orbit about the centre of the stator at an orbit frequency $\omega_{orbit}$ which is equal to the drive frequency $\omega_{drive}$. This is also the excitation frequency of the fluid column. The orbital motion induces the spinning motion. This arrangement requires a higher drive speed to achieve the same excitation frequency as the previous arrangement, but allows for a more compact layout. In this case, the pressure forces are carried by a bearing element (not shown) rather than the stator pins as in the previous arrangement.

Figure 11:
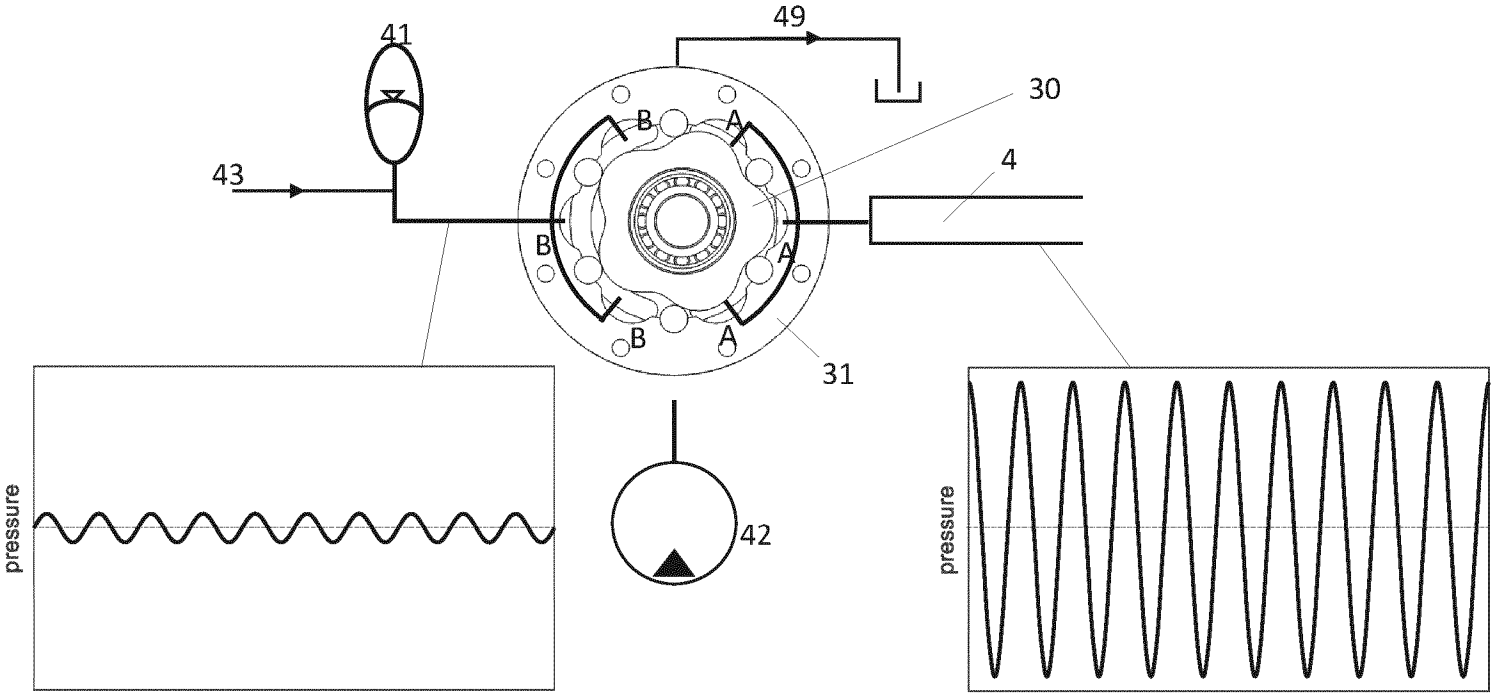
FIG. 11 is a schematic representation of a system comprising the epicycloid mechanism of FIGS. 10A and 10B connected to a drilling device according to the present invention.

In the embodiments described above in relation to FIGS. 9 and 10, only one of the two sets of cavities is connected to the fluid column. In this case, the rotor is subjected to pressure forces as follows:

$$F_{max}=p_{max}*A_{pressure}$$

$$F_{min}=p_{min}*A_{pressure},$$

where $p_{min}$ and $p_{max}$ are the maximum and minimum pressures in the fluid column and $A_{pressure}$ is the area upon which the pressure is acting. In an alternate embodiment, the second set of cavities may be connected to a constant pressure source with a pressure equal to the mean pressure of the fluid column, $p_{mean}$. This reduces pressure forces on the rotor substantially:

$$F_{max}=(p_{max}-p_{mean})*A_{pressure}$$

$$F_{min}=-(p_{mean}-p_{min})*A_{pressure},$$

or $$F_{max/min}=\pm(p_{amp})*A_{pressure},$$

where $p_{amp}$ is pressure oscillation amplitude in the fluid column. Thus, the maximum force on the rotor is at least 50% lower than in the case where the second set of cavities is not connected to a pressure source. The constant pressure source may be provided by a gas accumulator 41 connected to the B cavities, as shown in FIG. 11. The A cavities are in fluid communication with the fluid column as before and the rotor is driven by driver motor 42. There will be a slight variation in the pressure supplied by the accumulator, but the variation is small once the gas accumulator is relatively large. As shown in FIG. 11, the pressure forces on the rotor are much reduced as compared with the pressure variation in the fluid column. As the rotor 30 has no seals, there will be leakages between the A and B cavities and from the cavities to the driver shaft casing. The arrangement shown in FIG. 11 also allows for compensation for the leakages 49 between the cavities and the driver shaft casing by connecting the B cavities to a pressure source 43 at the same pressure as the mean pressure in the fluid column.

Figure 12:
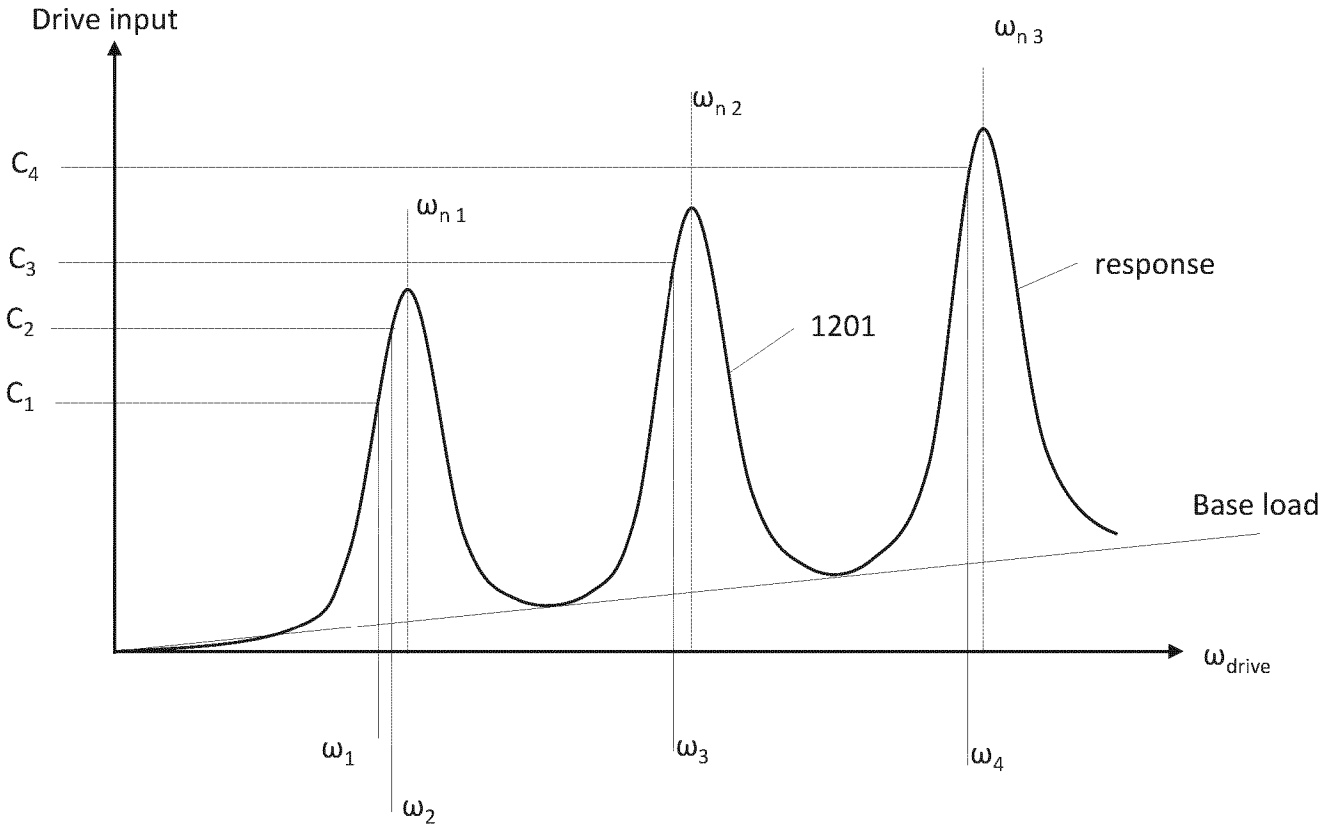
FIG. 12 is a graph of frequency response versus input torque for a drilling device of according to the present invention.

FIG. 12 illustrates the required input torque to excite a drilling device according to the present invention at various frequencies. The peaks in the response 1201 correspond to the natural frequencies of the system. As the excitation frequency gets close to one of the natural frequencies, the additional torque required to increase the excitation frequency increases. If the torque input to the displacement excitation device is $C_1$ and the system starts from rest, it will seek to operate at an excitation frequency $\omega_1$, close to the first natural frequency $\omega_{n1}$ of the device. If the input torque is increased to $C_2$, the excitation frequency is $\omega_2$, which is closer to the first natural frequency $\omega_{n1}$. A further increase of the input torque to $C_3$ causes a jump in excitation frequency to $\omega_3$, which is close to the second natural frequency $\omega_{n2}$. A further increase in input torque to $C_4$ increases the excitation frequency to $\omega_4$, close to the third natural frequency. Thus, by selecting an appropriate the input torque, the distance of the excitation frequency from the natural frequency, and thus, the drilling speed, can be selected.

Figure 13:
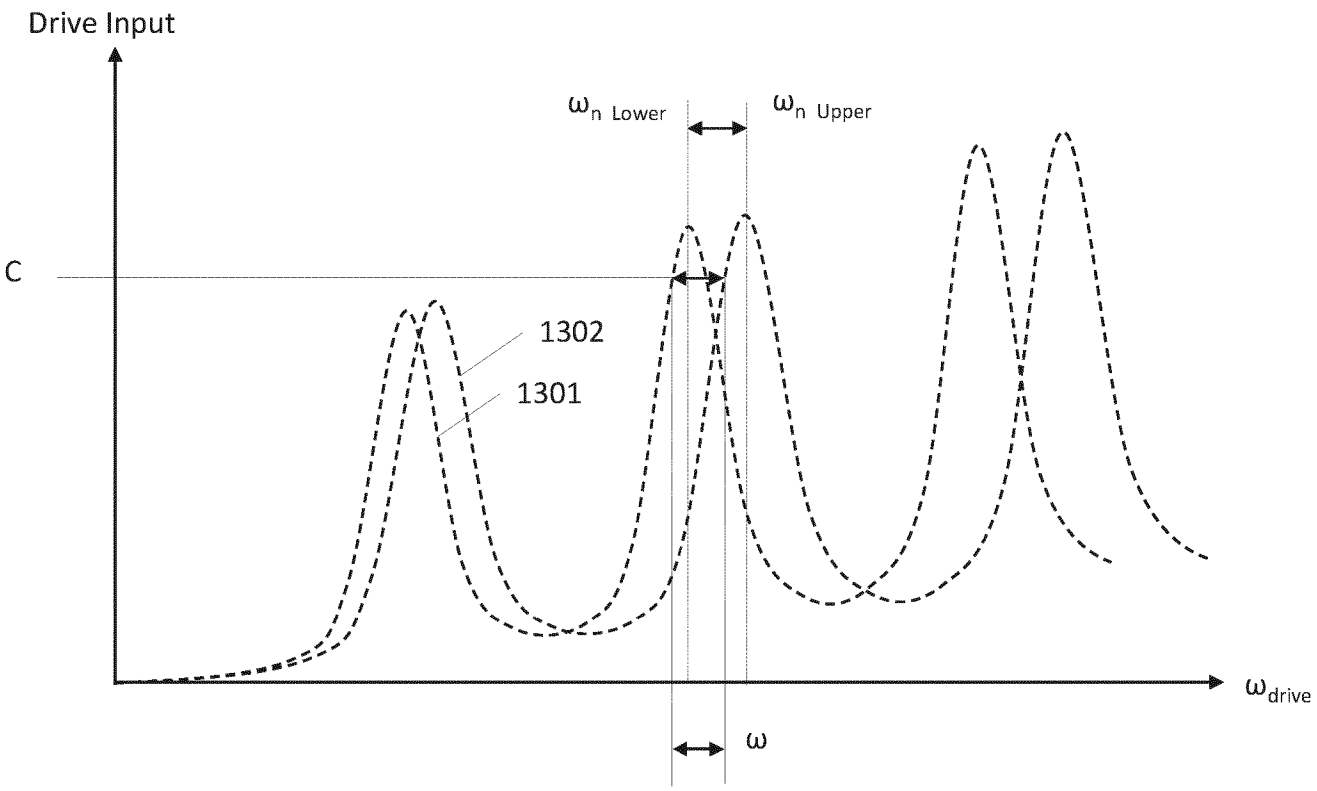
FIG. 13 is a graph of frequency response versus input torque for different drilling conditions for a drilling device according to the present invention.
Figures 14A, 14B:
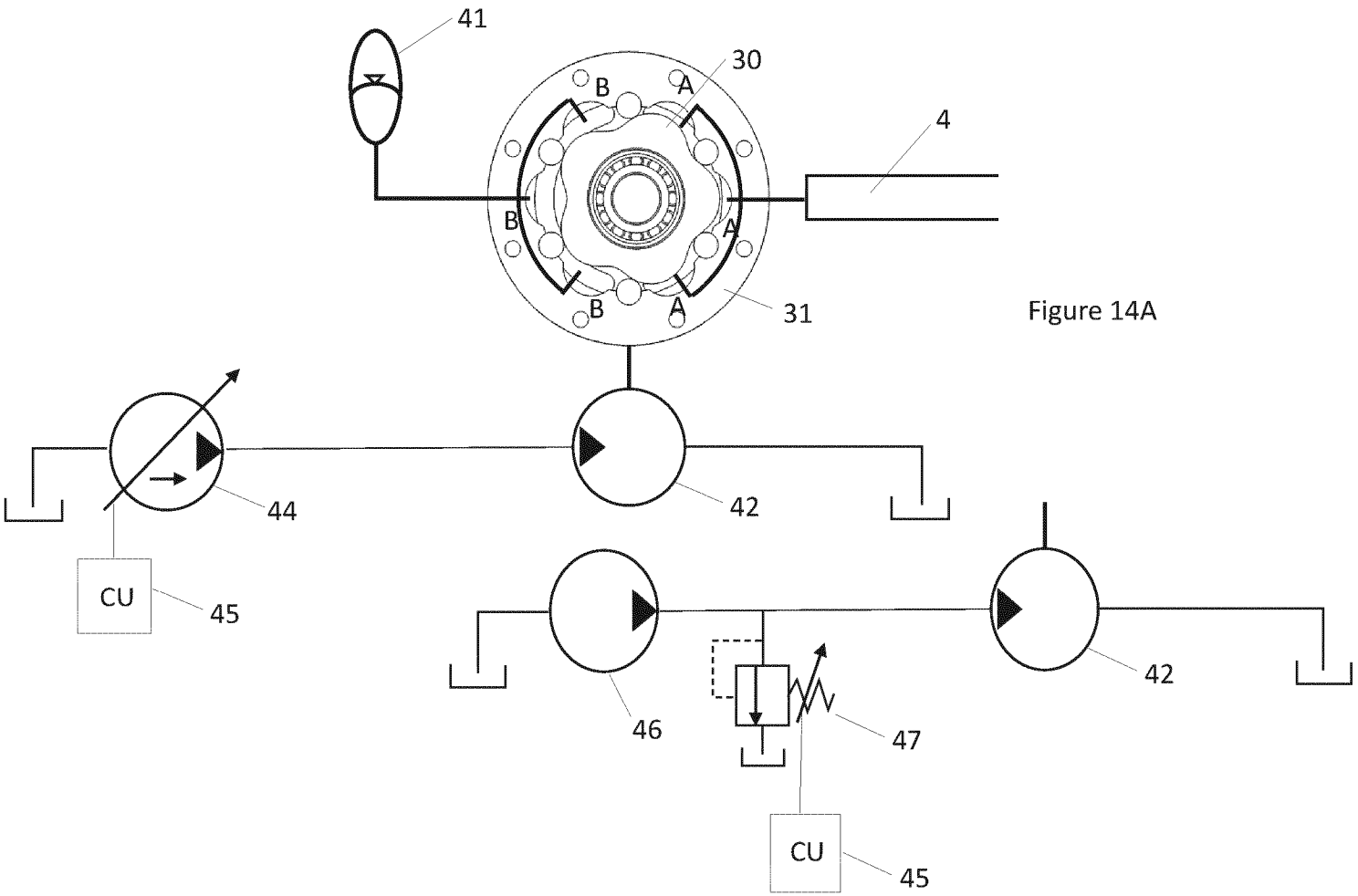
FIGS. 14A and 14B are schematic representations of control arrangements for the system of FIG. 11.

FIG. 13 illustrates how the frequency response varies based on differing rock conditions. A first response curve 1301 corresponds to a first rock condition and a second response curve 1302 corresponds to a second rock condition. For a constant input torque C, the excitation frequency will vary depending on rock conditions. In other embodiments, rather than torque, the control input may be input pressure or input power to the driver motor 42. FIGS. 14A and 14B illustrate possible control arrangements for the system shown in FIG. 11. In FIG. 14A, the control arrangement comprises a pressure compensated pump 44 which is controlled by a control unit 45 (or manually) to provide a constant drive pressure for the motor 42. Alternatively, the pump can be controlled to provide a constant output power to the drive motor. In FIG. 14B, the pump is a fixed displacement pump 46 and an adjustable pressure relief valve 47 is controlled by the control unit 45 to provide the required input pressure $p_{control}$ to the drive motor.

Figure 15A:
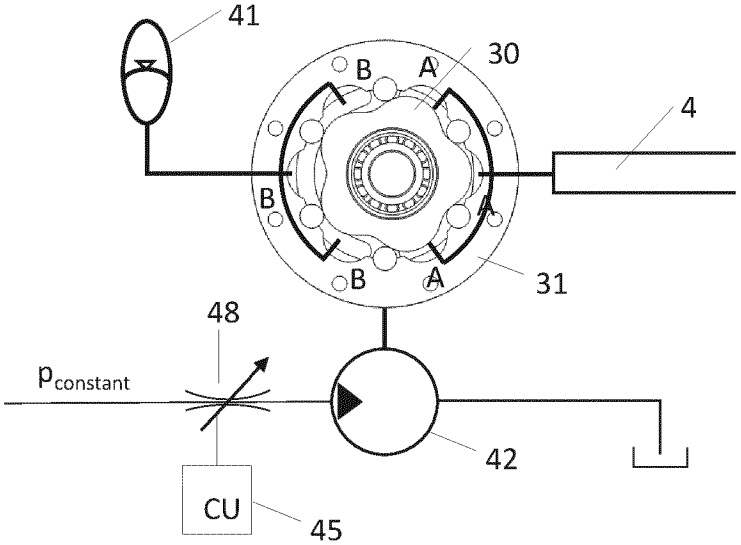
FIGS. 15A and 15B are schematic representations of alternative control arrangements for the system of FIG. 11.
Figure 15B:
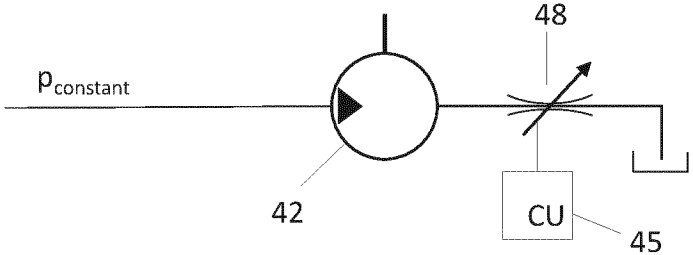

Further examples of control arrangements for the system shown in FIG. 11 are illustrated in FIGS. 15A and 15B. In these embodiments, an adjustable flow restrictor, such as a needle valve 48, is provided in a supply line to the driver motor 42 (as shown in FIG. 15A) or in a tank line (as shown in FIG. 15B). The driver pressure of the motor 42 is $p_{constant}$, less the drop across the needle valve 48. The pressure drop is a function of the opening of the valve and the flow rate through the valve, that is, the speed of the motor. The needle valve can be adjusted by the control unit 45 or manually. The control unit may comprise a solenoid as an actuator, a voltage or current regulator and a potentiometer to control the regulator output.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A drilling device for forming a drilled hole, the drilling device comprising:

at least one drill rod, the or each drill rod being disposed in the drilled hole during use and having a first cylindrical wall defining an elongate chamber for receiving a working fluid to form a fluid column, the length of the fluid column being equal to a total length of the elongate chambers of the or each drill rod;

a displacement excitation device arranged at a proximal end of the fluid column and configured to excite the fluid column to cause the working fluid in the fluid column to oscillate, wherein the excitation device is configured to excite the fluid column at an excitation frequency at or within 10% of a natural frequency of the fluid column determined based on the fluid column having a fixed boundary condition at the proximal end thereof; and a tool piston moveably mounted at a distal end of the fluid column and a drilling tool connected to the tool piston such that the oscillation of the working fluid in the fluid column imparts an oscillating force to the drilling tool, wherein the displacement excitation device reciprocally moves the working fluid in the fluid column in a longitudinal direction of the fluid column.

2. The drilling device as claimed in claim 1, wherein the drilling tool is a rotary tricone bit and wherein the drilling device is rotatable about a longitudinal axis.

3. The drilling device as claimed in claim 1, wherein the working fluid is a liquid.

4. The drilling device as claimed in claim 3, wherein the liquid is hydraulic oil.

5. The drilling device as claimed in claim 3, wherein the liquid is water.

6. The drilling device as claimed in claim 5, further comprising:

at least one outlet for water at a distal end of the fluid column;

means for pumping water into the fluid column at an input flow rate;

such that the water flows along a leakage fluid path between the first cylindrical wall and the tool piston and out of the at least one outlet at a leakage flow rate equal to the input flow rate.

7. The drilling device as claimed in claim 6, wherein:

the or each drill rod comprises a second cylindrical wall arranged outside at least a portion of the first cylindrical wall such that an annular flushing channel is defined between the first and second cylindrical walls and the annular flushing channel is configured to receive a flushing fluid at a proximal end thereof and discharge the flushing fluid at a distal end thereof; and the outlet for water is provided adjacent the distal end of the flushing channel.

8. The drilling device as claimed in claim 6, wherein:

the outlet is provided at a distal face of the drilling tool.

9. The drilling device as claimed in claim 1, wherein:

the or each drill rod comprises a second cylindrical wall arranged inside the first cylindrical wall such that the elongate chamber is an annular elongate chamber defined between the first and second cylindrical walls and a flushing channel is defined within the second cylindrical wall and the flushing channel is configured to receive a flushing fluid at a proximal end thereof and discharge the flushing fluid at a distal end thereof.

10. The drilling device as claimed in claim 1, wherein each elongate chamber has a length l and the length of the fluid column is an integer multiple of l.

11. The drilling device as claimed in claim 1, wherein the displacement excitation device comprises an excitation piston disposed in a proximal end of the chamber such that a forward end of the excitation piston forms a proximal end wall of the fluid column and coupled to a crankshaft mechanism such that the piston is driveable reciprocally in a longitudinal direction of the fluid column to reciprocally displace the proximal end wall of the fluid column.

12. The drilling device as claimed in claim 1, wherein the displacement excitation device comprises a cam mechanism arranged at a proximal end of the chamber such that each of a plurality of pistons is driveable reciprocally in a radial direction by a rotatable cam, to change the volume of the chamber in which the fluid column is established in a reciprocal fashion.

13. The drilling device as claimed in claim 1, wherein the displacement excitation device comprises an epicycloid mechanism comprising a multi-lobed rotor having N lobes arranged to orbit within a multi-lobed stator having N+1 lobes, such that N+1 cavities of varying volume are created between the rotor and the stator, and wherein a first group of the N+1 cavities are in fluid communication with each other and with the chamber to change the volume of the chamber in which the fluid column is established in a reciprocal manner.

14. The drilling device as claimed in claim 13, wherein a second group of the N+1 cavities are in fluid communication with each other and connected to a source of fluid at a substantially constant pressure.

15. A method of controlling an excitation frequency of a drilling device for forming a drilled hole, the drilling device including at least one drill rod, the or each drill rod being disposed in the drilled hole during use and having a first cylindrical wall defining an elongate chamber for receiving a working fluid to form a fluid column, the length of the fluid column being equal to a total length of the elongate chambers of the or each drill rod, a displacement excitation device arranged at a proximal end of the fluid column and configured to excite the fluid column to cause the working fluid in the fluid column to oscillate, wherein the excitation device is configured to excite the fluid column at an excitation frequency at or within 10% of a natural frequency of the fluid column determined based on the fluid column having a fixed boundary condition at the proximal end thereof, and a tool piston moveably mounted at a distal end of the fluid column and a drilling tool connected to the tool piston such that the oscillation of the working fluid in the fluid column imparts an oscillating force to the drilling tool, the method comprising:

setting an input torque for the displacement excitation device, whereby the excitation frequency is determined based at least on the input torque and a frequency response of the fluid column, wherein the displacement excitation device reciprocally moves the working fluid in the fluid column in a longitudinal direction of the fluid column.

16. The method as claimed in claim 15, wherein the excitation frequency is further based on a condition of a material to be drilled.

* * * * *